US011571347B2

(12) United States Patent
Zerhusen et al.

(10) Patent No.: US 11,571,347 B2
(45) **Date of Patent: *Feb. 7, 2023**

(54) PATIENT CONTROL ARM WITH PHONE DOCK AND HEAD-OF-BED LOCKOUT

(71) Applicant: Hill-Rom Services, Inc., Batesville, IN (US)

(72) Inventors: Robert M. Zerhusen, Cincinnati, OH (US); Michael Provinzano, Billerica, MA (US); Daniel Nachtigal, Brookline, MA (US)

(73) Assignee: Hill-Rom Services, Inc., Batesville, IN (US)

( * ) Notice: Subject to any disclaimer, the term of this patent is extended or adjusted under 35 U.S.C. 154(b) by 108 days.

This patent is subject to a terminal disclaimer.

(21) Appl. No.: 16/867,598

(22) Filed: May 6, 2020

(65) Prior Publication Data

US 2020/0261291 A1 Aug. 20, 2020

Related U.S. Application Data

(63) Continuation of application No. 16/451,359, filed on Jun. 25, 2019, which is a continuation of application
(Continued)

(51) Int. Cl.
*A61G 7/018* (2006.01)
*A61G 7/05* (2006.01)
(Continued)

(52) U.S. Cl.
CPC ..... *A61G 7/018* (2013.01); *A61G 7/0503* (2013.01); *A61G 7/0513* (2016.11);
(Continued)

(58) Field of Classification Search
CPC .. A61G 2203/12; A61G 7/018; A61G 7/0524; A61G 7/015; A61G 2203/10; A61G 7/0513; A61G 7/0503; A61G 2203/42
See application file for complete search history.

(56) References Cited

U.S. PATENT DOCUMENTS 1,915,985 A 6/1933 Edwards
2,208,945 A 7/1940 Miller
(Continued)

FOREIGN PATENT DOCUMENTS

CA 789207 7/1968
DE 2037932 2/1972
(Continued)

OTHER PUBLICATIONS

Ep Search Report for Application No. 15175485.0, dated Dec. 11, 2015 (10 pages).
(Continued)

*Primary Examiner* — Eric J Kurilla
*Assistant Examiner* — Amanda L Bailey
(74) *Attorney, Agent, or Firm* — Barnes & Thornburg LLP

(57) ABSTRACT

A patient control unit for controlling functions of a hospital bed includes a housing having a first side that includes a plurality of user inputs to control the functions of the hospital bed. The housing has a second side that includes a dock to secure a handheld phone in place on the housing. A hospital bed has a head-of-bed angle (HOBA) lockout selector that is used to signal a controller to prevent a head section of the bed from being moved below a threshold.

18 Claims, 4 Drawing Sheets

Related U.S. Application Data

No. 14/725,500, filed on May 29, 2015, now Pat. No. 10,363,182.

(60) Provisional application No. 62/023,994, filed on Jul. 14, 2014.

(51) Int. Cl.

| | |
|---|---|
| ***A61G 7/053*** | (2006.01) |
| *A61G 7/012* | (2006.01) |
| *A61G 7/015* | (2006.01) |

(52) U.S. Cl.

CPC ..... *A61G 7/0533* (2013.01); *A61G 7/012* (2013.01); *A61G 7/015* (2013.01); *A61G 2203/10* (2013.01); *A61G 2203/42* (2013.01)

(56) References Cited

U.S. PATENT DOCUMENTS

| | | | | |
|---|---|---|---|---|
| 2,384,325 | A | 9/1945 | Marsan | |
| 2,439,009 | A | 4/1948 | Kujawski | |
| 2,605,155 | A | 7/1952 | Lewis | |
| 2,607,881 | A | 8/1952 | Anderson | |
| 3,030,128 | A | 4/1962 | Versen | |
| 3,112,968 | A | 12/1963 | Cotton et al. | |
| 3,200,416 | A | 8/1965 | Warrick | |
| 3,243,497 | A | 3/1966 | Kendall et al. | |
| 3,358,957 | A | 12/1967 | Lindenmuth | |
| 3,662,981 | A | 5/1972 | Hogrebe | |
| 3,757,363 | A | 9/1973 | Langlais | |
| 3,798,684 | A | 3/1974 | Benoit et al. | |
| 3,839,753 | A | 10/1974 | Benoit et al. | |
| 3,875,356 | A | 4/1975 | Heim et al. | |
| 3,889,914 | A | 6/1975 | Torme | |
| 3,977,645 | A | 8/1976 | Deely | |
| 4,023,757 | A | 5/1977 | Allard et al. | |
| 4,183,015 | A | 1/1980 | Drew et al. | |
| 4,183,489 | A | 1/1980 | Copher et al. | |
| 4,287,620 | A | 9/1981 | Zur | |
| 4,410,158 | A | 10/1983 | Maffei | |
| 4,435,862 | A | 3/1984 | King et al. | |
| 4,453,965 | A | 6/1984 | Sennott et al. | |
| 4,465,255 | A | 8/1984 | Hill | |
| 4,489,454 | A | 12/1984 | Thompson | |
| 4,591,124 | A | 5/1986 | Hellenbrand et al. | |
| 4,612,679 | A | 9/1986 | Mitchell | |
| 4,680,790 | A * | 7/1987 | Packard | H04M 1/05 340/286.07 |
| 4,780,919 | A | 11/1988 | Harrison | |
| 4,803,744 | A | 2/1989 | Peck et al. | |
| 4,821,348 | A | 4/1989 | Pauna | |
| 4,846,434 | A | 7/1989 | Krogsrud | |
| 5,023,967 | A | 6/1991 | Ferrand | |
| 5,072,906 | A | 12/1991 | Foster | |
| 5,100,091 | A | 3/1992 | Pollak | |
| 5,186,337 | A | 2/1993 | Foster et al. | |
| 5,211,367 | A | 5/1993 | Musculus | |
| 5,230,289 | A | 7/1993 | George et al. | |
| 5,239,300 | A | 8/1993 | Berger et al. | |
| 5,255,403 | A | 10/1993 | Ortiz | |
| 5,335,313 | A | 8/1994 | Douglas | |
| 5,335,384 | A | 8/1994 | Foster et al. | |
| 5,465,082 | A | 11/1995 | Chaco | |
| 5,479,666 | A | 1/1996 | Foster et al. | |
| 5,542,136 | A | 8/1996 | Tappei | |
| 5,542,138 | A | 8/1996 | Williams et al. | |
| 5,592,153 | A | 1/1997 | Welling et al. | |
| 5,594,963 | A | 1/1997 | Berkowitz | |
| 5,611,096 | A | 3/1997 | Bartlett et al. | |
| 5,715,548 | A | 2/1998 | Weismiller et al. | |
| 5,838,223 | A | 11/1998 | Gallant et al. | |
| 6,131,868 | A | 10/2000 | Welling et al. | |
| 6,147,592 | A | 11/2000 | Ulrich et al. | |
| 6,163,903 | A | 12/2000 | Weismiller et al. | |
| 6,336,235 | B1 | 1/2002 | Ruehl | |
| 6,481,688 | B1 | 11/2002 | Welling et al. | |
| 6,486,792 | B1 * | 11/2002 | Moster | A47C 31/008 340/4.11 |
| 7,017,243 | B2 | 3/2006 | Carnevali | |
| 8,295,130 | B2 * | 10/2012 | Claessens | G04B 25/00 368/256 |
| 8,583,144 | B2 | 11/2013 | Kavounas | |
| 8,833,716 | B2 * | 9/2014 | Funk | F16M 13/022 248/316.4 |
| 10,363,182 | B2 | 7/2019 | Zerhusen et al. | |
| 2006/0056616 | A1 | 3/2006 | Heimbrock | |
| 2007/0143290 | A1 | 6/2007 | Frondorf et al. | |
| 2007/0157385 | A1 | 7/2007 | Lemire | |
| 2007/0163045 | A1 | 7/2007 | Becker et al. | |
| 2008/0172789 | A1 * | 7/2008 | Elliot | A61G 7/018 5/616 |
| 2011/0227535 | A1 | 9/2011 | Caskey et al. | |
| 2012/0104211 | A1 | 5/2012 | Saijo | |
| 2013/0206942 | A1 | 8/2013 | Trotsky | |
| 2014/0042285 | A1 | 2/2014 | Carnevali | |
| 2016/0008197 | A1 | 1/2016 | Zerhusen et al. | |
| 2019/0314231 | A1 | 10/2019 | Zerhusen et al. | |

FOREIGN PATENT DOCUMENTS

| | | |
|---|---|---|
| DE | 3240145 | 5/1984 |
| DE | 3310463 | 9/1984 |
| DE | 3314938 | 10/1984 |
| DE | 8614525 | 12/1986 |
| DE | 4127013 | 2/1993 |
| DE | 4127014 | 2/1993 |
| DE | 4214143 | 11/1993 |
| EP | 0363555 | 4/1990 |
| EP | 0376066 | 7/1990 |
| EP | 0568020 | 11/1993 |
| EP | 0780111 | 6/1997 |
| EP | 1652504 | 5/2006 |
| EP | 2308440 | 4/2011 |
| EP | 2374442 | 10/2011 |
| JP | 11-262506 | 9/1999 |
| JP | 2006-515995 | 6/2006 |
| JP | 2011-78781 | 4/2011 |
| JP | 2014-50703 | 3/2014 |
| WO | 96/33641 | 10/1996 |
| WO | 03/014871 | 2/2003 |
| WO | 2004/021952 | 3/2004 |
| WO | 2013/028261 | 2/2013 |

OTHER PUBLICATIONS

Extended European Search Report dated Sep. 29, 2017 for European Patent Application No. 17183373.4 (8 pages).

Office Action for Jp 2017-081517 dated Mar. 6, 2018 (including English translation) (9 pages).

Office Action dated Aug. 21, 2018 in Japanese Patent Application No. 2017-081517 and its English translation (9 pages).

* cited by examiner 70
72
74
78
80
82
84
86
10
48a
48c
100'
138
140
142
144'
146
148
150
152
154
156
158
160
162
162a
162b
164
166
168

PATIENT CONTROL ARM WITH PHONE DOCK AND HEAD-OF-BED LOCKOUT

CROSS REFERENCE TO RELATED APPLICATIONS

The present application is a continuation of U.S. application Ser. No. 16/451,359, which is a continuation of U.S. application Ser. No. 14/725,500, filed May 29, 2015, now U.S. Pat. No. 10,363,182, which claims the benefit, under 35 U.S.C. § 119(e), of U.S. Provisional Application No. 62/023,994, which was filed Jul. 14, 2014, and each of which is hereby incorporated by reference herein in its entirety.

BACKGROUND

The present disclosure relates to features of patient support apparatuses such as hospital beds. In one aspect, the present disclosure relates to patient control arms having user inputs that a patient uses to control features and functions of hospital beds, as well as other features and functions. In another aspect, the present disclosure relates to user inputs for locking out the ability to use one or more controls or features of a patient support apparatus.

Handheld personal phones, aka smartphones, are owned by a large percentage of the population. Many owners of these phones often believe they could not function adequately without them. Patients in healthcare facilities prefer to have their phones accessible while admitted to a healthcare facility. However, current patient support apparatuses on the market today do not adequately address patients' desire for ease of use of their smartphones while confined to a patient support apparatus. Some patient's and caregivers may wish to interact with one another via the patient's phone. Other aspects of a patient's care while in a healthcare facility may be enhanced if a patient has access to their phone. Allowing patients better ergonomic use of their personal phones while confined to a hospital bed, for example, may improve their experience while in a hospital or other healthcare facility.

It is sometimes desirable for a patient to be supported in a patient support apparatus, such as a hospital bed, with a head section of a mattress support deck of the bed elevated above a threshold angle. The Joint Committee on Accreditation of Healthcare Organizations (JCAHO) recommends that, under some circumstances, a patient be supported on a hospital bed in a semi-recumbent position, instead of a supine position, to reduce the risk of Ventilator-Associated Pneumonia (VAP) occurrence. JCAHO recommends head-of-bed angle (HOBA) for mechanically ventilated patients of at least 45 degrees in order to prevent pneumonia. For patients at high risk of skin breakdown, a HOBA of at least 30 degrees is recommended in order to prevent pneumonia and the development of pressure ulcers. See U.S. Pat. No. 7,487,562 in this regard.

Some existing hospital beds have an alarm that sounds and/or that is sent as an alarm signal to a remote computer device, such as a nurse call computer, if the head section of the bed is lowered below the threshold angle while a HOBA monitoring system has been armed or enabled. This type of prior art bed is described in the '562 patent mentioned above. Minimizing the number of alarms in a healthcare facility to which caregivers must respond, including head of bed angle alarms, may increase caregiver productivity.

SUMMARY

An apparatus, system, or method may comprise one or more of the features recited in the appended claims and/or the following features which, alone or in any combination, may comprise patentable subject matter:

A patient control unit for controlling functions of a hospital bed may be provided. The patient control unit may include a housing having a first side that may include a plurality of user inputs to control the functions of the hospital bed. The housing may have a second side that may include a dock to secure a handheld phone in place on the housing.

The dock may comprise, for example, a clamp such as a clamp that may have a pair of clamp members. At least one clamp member of the pair of clamp members may be spring loaded and may be movable to permit the dock to accommodate handheld phones of different sizes. At least one clamp member of the pair of clamp members may have a notch through which a plug may access a port of the handheld phone when the handheld phone is secured to the dock.

In some embodiments, the housing may have a first side edge extending between the first side and the second side. The first side edge may be formed to include a cord wrap around which slack of a cord of the handheld phone may be wrapped. The cord wrap may comprise a cleat that may have first and second cleat arms. A plug port may be situated between the first and second cleats arms. The plug port may be configured for receipt of a plug of a cord of the handheld phone.

According to the present disclosure, the housing may have a first stay-in-bed indicia that may be illuminated when a patient position monitoring system of the hospital bed is armed. The first stay-in-bed indicia may be located generally above the handheld phone when the handheld phone is secured to the dock and the second side of the housing is oriented generally vertically. The housing may have a second stay-in-bed indicia that may be illuminated when the patient position monitoring system of the hospital bed is armed. The second stay-in-place indicia may be located above the user inputs when the first side of the housing is oriented generally vertically.

Further according to the present disclosure, the plurality of user inputs on the first side of the housing may include a nurse call button. The patient control unit may further include a second nurse call button on the second side of the housing. Each of the first and second nurse call buttons may be usable to send a nurse call signal from the hospital bed to a nurse call system. The second nurse call button may be located generally beneath the handheld phone when the handheld phone is secured to the dock and the second side of the housing is oriented generally vertically.

According to this disclosure, the patient control unit may include an arm assembly that may have a first end coupled to the housing and that may have a second end coupled to the hospital bed. For example, the second end of the arm assembly may be coupled to a pivotable head section of the hospital bed. The arm assembly may include an arm that may be configured to suspend the housing over a torso of a patient supported on the hospital bed. In some embodiments, the housing may be pivotable relative to the arm between a first position in which the first side of the housing may be presented to the patient and a second position in which the second side of the housing may be presented to the patient. The housing may have a top edge extending between the first and second sides and the first end of the housing may be coupled to the top edge of the housing.

The first and second sides of the housing are generally parallel to one another and face in opposite directions. The housing may be formed to include an aperture that may define a grip handle at a bottom of the housing such that the user inputs may be located above the grip handle on the first side of the housing and the dock may be located above the grip handle on the second side of the housing. In some embodiments, the housing may be generally trapezoidal in shape when viewed facing the first side and when viewed facing the second side.

According to another aspect of the present disclosure, a patient support apparatus may comprise a frame and a head section. The head section may be coupled to the frame and may be movable relative to the frame between raised and lowered angular positions. For example, the head section may be configured to support at least a portion of a torso of a patient. The patient support apparatus may further have a sensor that may be operable to provide a sensor signal indicative of an angular position of the head section. An actuator may be operable to move the head section between the raised and lowered angular positions. A controller may be coupled to the sensor and to the actuator. The controller may be configured to signal the actuator to move the head section.

The patient support apparatus may have a head-of-bed angle (HOBA) lockout selector that may be coupled to the controller. The HOBA lockout selector may have an on state and an off state. The controller may be prevented from signaling the actuator to move the head section below a threshold HOBA that may be defined between the raised and lowered angular positions when the HOBA selector is in the on state. The controller may be permitted to signal the actuator to move the head section throughout a full range of motion between the raised and lowered angular positions when the HOBA selector is in the off state.

The sensor may include at least one of the following: a potentiometer, an inclinometer, a limit switch, or an accelerometer. In some embodiments, the sensor may be included as a component of the actuator. The actuator may comprise an electrical linear actuator, for example.

The HOBA lockout selector may include a button or a membrane switch in some embodiments. Alternatively or additionally, the HOBA lockout selector may be shown on a touchscreen display. In some embodiments, the HOBA lockout selector may be located on a surface of a barrier of the patient support apparatus such as a surface that may face away from a patient supported on the head section.

According to this disclosure, the controller may be configured to receive a signal from a remote computer to change the HOBA lockout selector between the on state and the off state. The threshold HOBA may be a fixed value that may be stored in a memory associated with the controller. The threshold HOBA may be selectable between first and second threshold angles. For example, the threshold HOBA may be selectable using a graphical caregiver interface of the patient support apparatus.

In some embodiments, the HOBA lockout selector may include a visual indicator to indicate whether the HOBA lockout selector is in the on state or the off state. The visual indicator may comprise a light, such as a light emitting diode, for example. The light may be illuminated when the HOBA lockout selector is in the on state and the light may be off when the HOBA lockout selector is in the off state.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
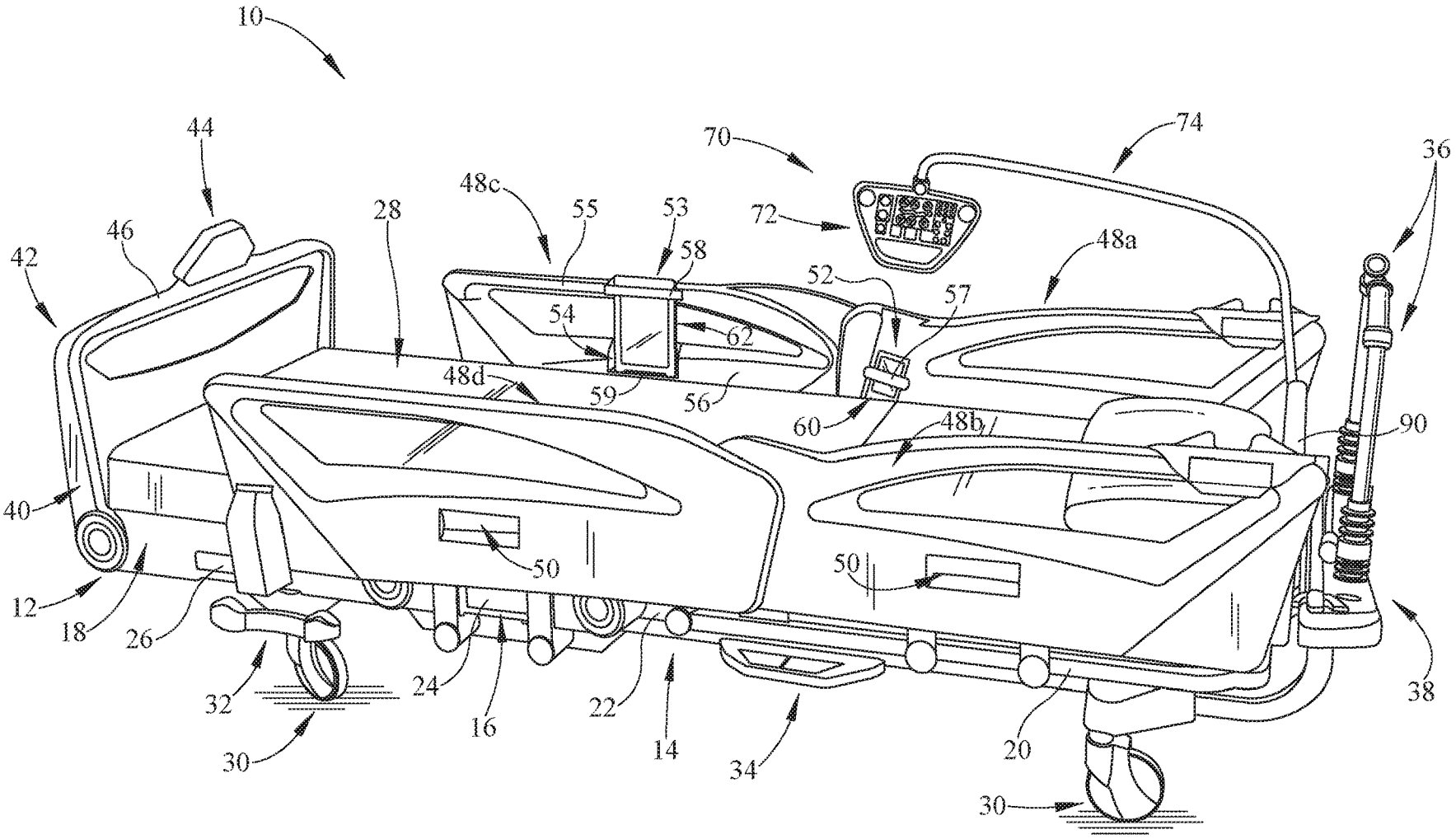
FIG. 1 is perspective view of a hospital bed having a patient control unit including a housing mounted to an arm assembly, the arm assembly being attached to a head section of the bed, and the arm assembly suspending a trapezoidal shaped housing for access by a patient (now shown)

A patient support apparatus, such as illustrative hospital bed 10, includes a frame 12 that, in turn, includes a base frame 14, an upper frame 16, and a patient support deck 18 as shown in FIG. 1. Deck 18 includes a head section 20, a seat section 22, a thigh section 24, and a foot section 26. Bed 10 has a mattress 28, sometimes referred to in the art as a patient support surface, supported atop sections 20, 22, 24, 26. One or more of sections 20, 22, 24, 26 are selectively movable relative to upper frame 16 to support a patient in a variety of positions. Bed 10 includes various actuators (not shown) that move the movable sections 20, 22, 24, 26 and that raise, lower, and tilt upper frame 16 relative to base frame 14 as is well known in the art. Examples of beds having such actuators are shown and described in U.S. Pat. Nos. 7,296,312 and 5,715,548, each of which is hereby expressly incorporated by referenced herein to the extent not inconsistent with the present disclosure which shall control as to any inconsistencies.

Bed 10 also has four casters 30 (only two of which can be seen in FIG. 1) and a pair of butterfly brake pedals 32 (only one of which can be seen in FIG. 1) which are used to brake and release casters 30 via a braking linkage or other similar mechanism as is known in the art. Another foot pedal assembly 34 is provided on the base frame 14 of illustrative bed 10 for raising and lowering one portion of the bed relative to another, also in a well-known manner. A pair of push handles 36 are provided at a head end 38 of bed 10 and are used by caregivers to push bed 10 from one location to another when casters 30 are unbraked or released.

Bed 10 has a footboard 40 coupled to foot deck section 18 at a foot end 42 of bed 10. In the illustrative example, a caregiver control pod 44 extends upwardly from a central region of a top bar 46 of footboard 40. Caregiver controls, in the form of user inputs such as one or more of buttons, switches, touchscreen displays, and the like are provided on the surface of pod 44 that faces away from mattress 28. Thus, the caregiver controls are generally inaccessible to a patient lying on mattress 28. In some embodiments, the caregiver controls on pod 44 are similar to one or more of the user inputs discussed below in connection with FIGS. 2, 4 and 5. Additional examples of caregiver controls are found in U.S. Patent Application Publication Nos. 2012/0089419 A1, 2012/0073054 A1 and 2008/0235872, each of which is hereby expressly incorporated by referenced herein to the extent not inconsistent with the present disclosure which shall control as to any inconsistencies.

Bed 10 also includes a set of siderails 48*a*, 48*b*, 48*c*, 48*d* as shown in FIG. 1. In the illustrative example, siderails 48*a*, 48*b* are head end siderails (aka "head rails") and siderails 48*c*, 48*d* are foot end siderails (aka "foot rails"). Each of siderails 48*a*. 48*b*, 48*c*. 48*d* has a hand-receiving recess 50 through which a release handle (not shown) is accessible for releasing a locking mechanism (not shown) so that the respective siderail 48*a*, 48*b*, 48*c*, 48*d* can be moved from a respective raised position (shown in FIG. 1) to a respective lowered position (not shown). Siderail 48*a* includes a phone-receiving recess 52 formed therein. Siderail 48*c* has a first tablet-receiving recess 53 formed in a top rail 55 thereof and a second tablet-receiving recess 54 formed in a main body 56 thereof.

Recess 52 is sized and configured to receive a patient's personal handheld phone 60 (e.g., a smartphone) therein. A retention bar 57 is provided on siderail 48*a* and bridges across recess 52 to help retain phone 60 therein as shown in FIG. 1. Recesses 53, 54 are sized and configured to receive a patient's personal tablet computer 62 therein. A retention bar 58 is provided on rail 55 of siderail 48*c* and bridges across recess 53 to help retain an upper region of tablet computer 62 therein and a retention rib 59 extends upwardly from main body 56 of siderail 48*c* adjacent to recess 54 to help retain a lower region of table computer 62 therein. Recesses 52, 53, 54 are provided in the surfaces of siderails 48*a*, 48*c* that face toward mattress 28 and the patient supported thereon. In some embodiments, similar surfaces of siderail 48*b*. 48*d* also include similar recesses and the accompanying retention bars and retention rib, but this need not be the case as most patients typically will have only one personal phone and/or one personal tablet computer. However, by providing all of siderails 48*a*. 48*b*, 48*c*, 48*d* with the illustrative recesses 52, 53, 54, a patient who has the use of only one arm can choose the appropriate side of bed 10 for storage of their respective devices.

Figure 2:
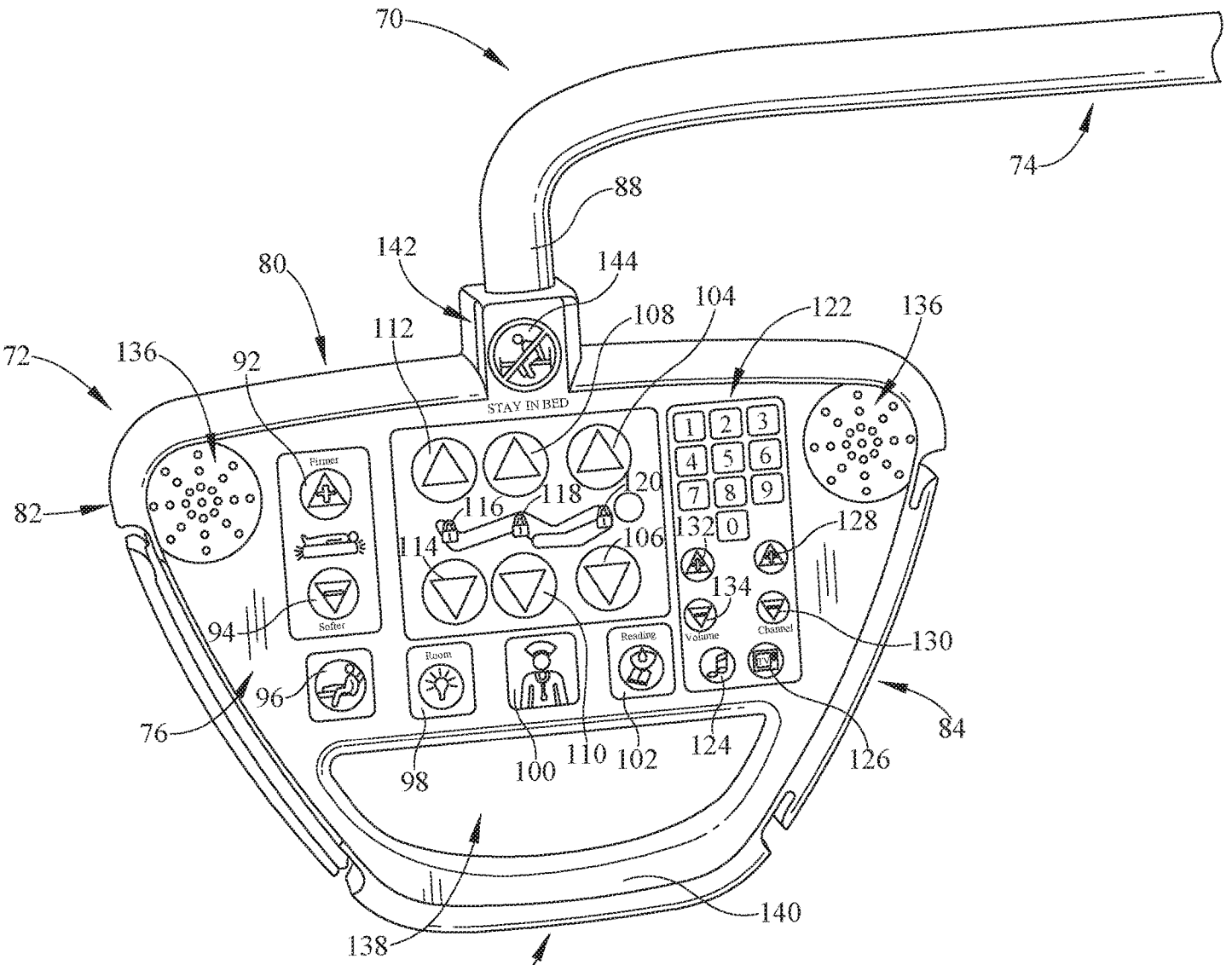
FIG. 2 is an enlarged perspective view showing the housing have a first side with user inputs to control various functions of the hospital bed as well as other features.

Bed 10 also include a patient control unit 70 that includes a generally trapezoidal shaped housing 72 and an arm assembly 74 as shown in FIG. 1. Housing 72 has a generally planar first side 76 (shown best in FIG. 2), a generally planar second side 78 (shown best in FIG. 3A), and perimetral edges including a top edge 80, a first side edge 82, a second side edge 84, and a bottom edge 86 as shown in FIG. 2. Edges 80, 82, 84, 86 interconnect the first and second sides 76, 78 to form the overall shape of housing 72. Arm assembly 74 has a first end 88 coupled to top edge 80 of housing 72 and a second end 90 coupled to head section 20 of frame 12 of bed 10. Arm assembly 74 is sized and configured so as to suspend housing 72 generally above a patient's torso region at a location where the patient can easily grab housing 72 with their hands.

Referring now to FIG. 2, first side 76 of housing 72 of patient control unit has user inputs and various indicia including the following:

- Mattress firmer button 92—pressed to signal a pneumatic system of bed 10 to increase the pressure in one or more air bladders of mattress 28;
- Mattress softer button 94—pressed to signal the pneumatic system of bed 10 to decrease the pressure in one or more air bladders of mattress 28;
- Patient egress button 96—pressed when a patient is egressing from a side of mattress 28 to increase the pressure in one or more seat zone bladders of mattress 28;
- Room light button 98—pressed to turn on and turn off a room light;
- Nurse call button 100—pressed to send a signal to one or more computer devices, including remote computer devices, of a nurse call system;
- Reading light button 102—pressed to turn on and turn off a reading light;
- Head up button 104—pressed to signal a control system of bed 10 to raise the head section 20;
- Head down button 106—pressed to signal the control system of bed 10 to lower the head section 20;
- Thigh up button 108—pressed to signal the control system of bed 10 to raise the thigh section 24;
- Thigh down button 110—pressed to signal the control system of bed 10 to lower the thigh section 24;
- Foot up button 112—pressed to signal the control system of bed 10 to raise the foot section 26;
- Foot down button—pressed to signal the control system of bed 10 to lower the foot section;
- Foot section lockout indicia 116—illuminates when the foot section 26 is locked out from movement;
- Thigh section lockout indicia 118—illuminates when the thigh section 24 is locked out from movement;
- Head section lockout indicia 120—illuminates when the head section 20 is locked out from movement;
- Phone key pad 122—includes buttons for numbers 0-9 arranged as a traditional telephone keypad for us by a patient in placing a telephone call;
- Radio button 124—pressed to turn a radio on and off;
- Television button 126—pressed to turn a television on and off;
- Channel up button 128—pressed to increase the radio channel or television channel, as the case may be;
- Channel down button 130—pressed to decrease the radio channel or television channel, as the case may be;
- Volume up button 132—pressed to increase the radio volume or television volume, as the case may be; and
- Volume down button 134—pressed to decrease the radio volume of television volume, as the case may be.

Speakers (not shown) are located behind speaker grills 136 in the upper comer regions of first side 76 as shown in FIG. 2. A large aperture 138 in housing 72 defines a hand grip 140 that a patient grasps to reposition housing 72. A central region of upper edge 80 of housing 72 is provided with a raised boss 142 and first end 88 of arm assembly 74 is received within boss 142. Housing 72 is rotatable relative to first end 88 of arm assembly 74 through at least 180 degrees, up to and including about 360 degrees in some embodiments. Thus, the housing 72 is pivotable relative to the arm assembly 74 between a first position in which the first side 76 of the housing is presented to the patient on bed 10 and a second position in which the second side 78 of the housing 74 is presented to the patient on bed 10. A stay-in-bed indicia is provided on boss 142 and is illuminated when a patient position monitoring (PPM) system of bed 10 is armed. Thus, the illuminated indicia 144 reminds a patient not to get out of bed when the PPM system is armed.

Figures 3A, 3B, 3C, 3D, 3E, 3F:
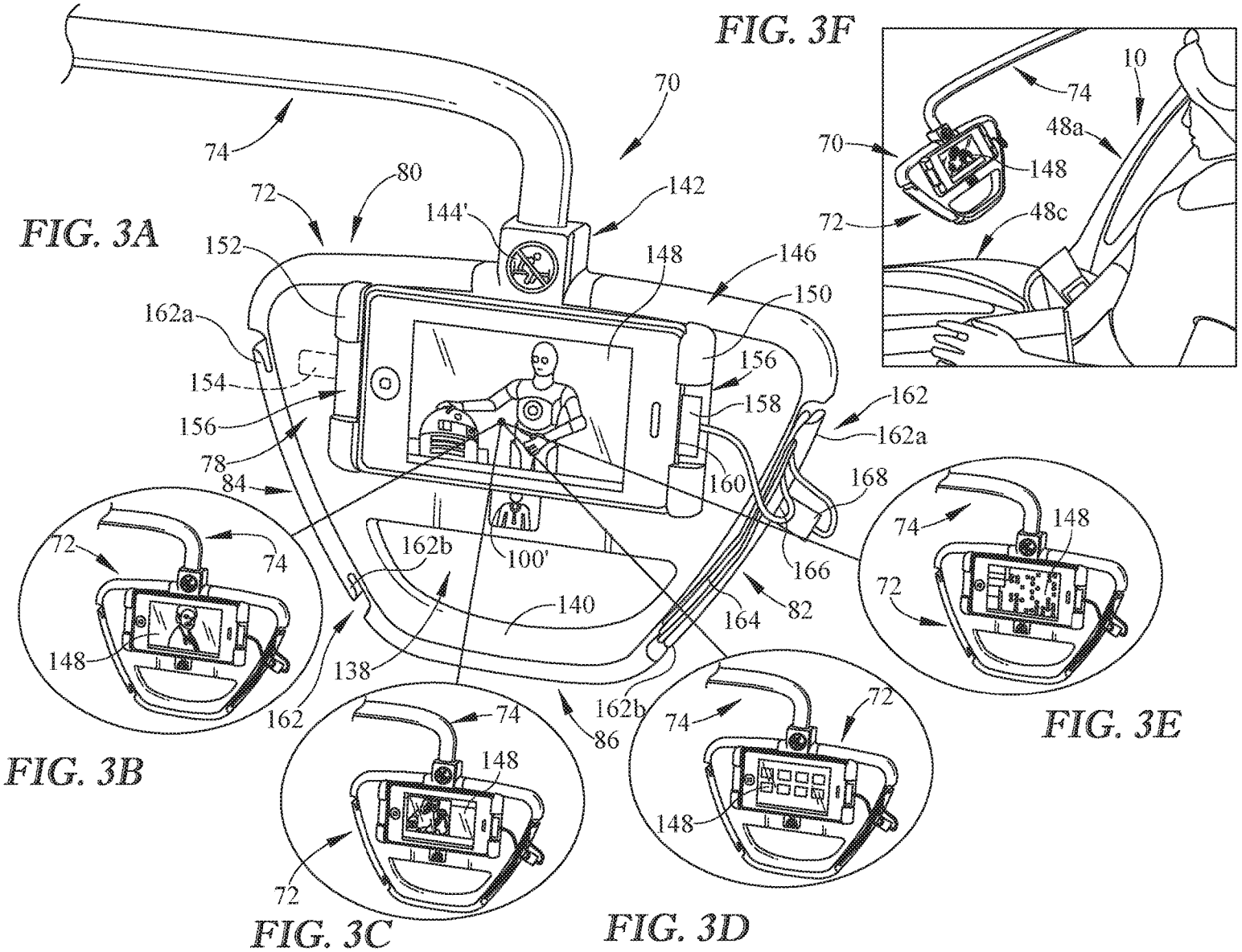
FIG. 3A is an enlarged perspective view, similar to FIG. 2, showing the housing having a second side with a handheld phone dock that includes a clamp with a pair of clamp members that grip the sides of the phone to secure the phone in place relative to the second side of the housing, the clamp members each having a notch through which a port of the phone is accessible, the housing having cord wraps formed in the opposite side edges thereof, and a plug port being provided along one of the side edges of the housing.
FIG. 3B is a perspective view, similar to FIG. 3A, showing the handheld phone being used for a physician videoconference.
FIG. 3C is a perspective view, similar to FIG. 3A, showing the handheld phone being used for a family videoconference.
FIG. 3D is a perspective view, similar to FIG. 3A, showing the handheld phone being used to operate software downloaded from a healthcare facility.
FIG. 3E is a perspective view, similar to FIG. 3A, showing the handheld phone being used for playing games.
FIG. 3F is a perspective view, similar to FIG. 3A, showing the handheld phone being viewed by a patient in the hospital bed when a head section of the bed is raised.

Referring now FIG. 3A, second side 78 of housing 72 includes a dock 146 to secure a handheld phone 148 in place on the housing 72. In the illustrative example, the dock 146 is configured as a clamp that includes a pair of clamp members 150, 152. Clamp member 152 is spring loaded and is movable toward and away from clamp member 150 to permit the dock 146 to accommodate handheld phones of different sizes. A spring 154 is shown diagrammatically (in phantom) in FIG. 3A. Spring 154 spring biases clamp member 152. Clamp member 150, therefore, is a stationary clamp member in the illustrative example. In other embodiments both clamp members 150, 152 are movable and spring biases. Clamp members 150, 152 each have a notch 156 through which a plug 158 may access a port 160 of the handheld phone 148 when the handheld phone 148 is secured to the dock. Notches 156 in members 150, 152 allow phone 148 to be secured to housing 72 in either direction and yet port 160 is still accessible through one notch 156 or the other.

Still referring to FIG. 3A, first side edge 82 and second side edge 84 are each formed to include a cord wrap 162 around which slack of a cord 164 of the handheld phone 148 is wrapped, if desired. In the illustrative example, each of the cord wraps 162 is in the form of a cleat that has first and second cleat arms 162*a*, 162*b*. A plug port 166 is situated between the first and second cleats arms 162*a*, 162*b* of one or both of cord wraps 162. The plug port 166 is configured for receipt of a plug 168 of the cord 164 of the handheld phone 148. In the illustrative example, plug port 166 is a Universal Serial Bus (USB) port.

In the illustrative example of housing 72, another stay-in-bed indicia 144' is provided on boss 142 on second side 78 of housing 72. Indicia 144' is located generally above the handheld phone 148 when the handheld phone 148 is secured to the dock 146 and the second side 78 of the housing 72 is oriented generally vertically as shown in FIG. 3A. Indicia 144' is illuminated at the same time as, and for the same purpose as, indicia 144 as described above. A nurse call button 100' is provided on second side 78 of housing 72 and is located generally beneath the handheld phone 148 when the handheld phone 148 is secured to the dock 146 and the second side 78 of the housing 72 is oriented generally vertically.

Referring now to FIGS. 3B-3E, various applications of phone 148 are illustrated as being in use while phone 148 is docked to the patient control unit 70. In FIG. 3B, phone 148 is being used for a physician videoconference. In FIG. 3C, phone 148 is being used for a family videoconference. In FIG. 3D, phone 148 is being used to operate software downloaded from a healthcare facility. Such software includes, for example, software that permits a patient to select icons that result in a specific message being sent to an assigned caregiver's wireless portable communication device, such as another handheld phone. In FIG. 3E, phone 148 is being used for playing games. Phone 148 and housing 72 can also be viewed by a patient when head section 20 is raised and the patient is sitting up in bed as shown in FIG. 3F.

Figure 4:
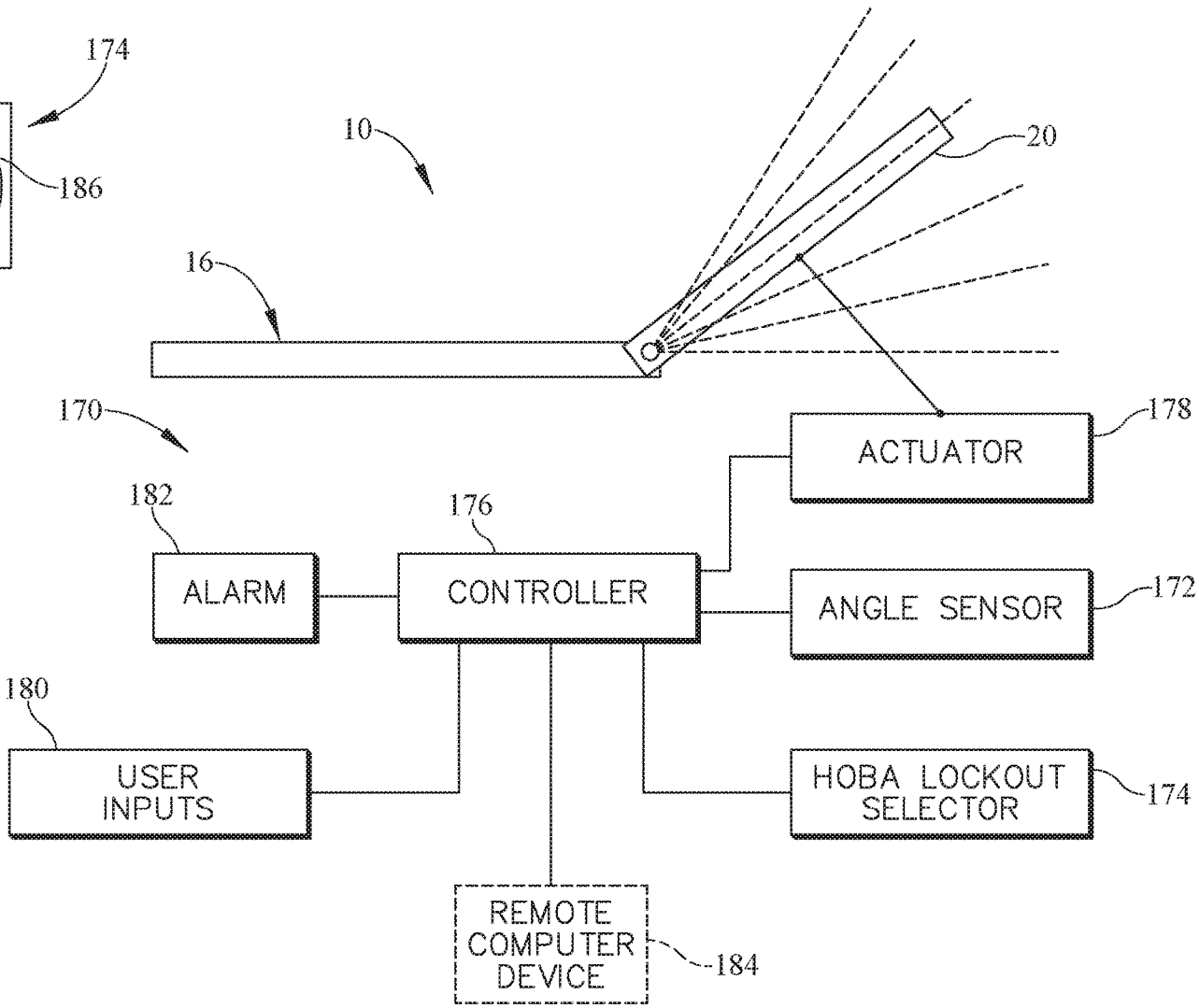
FIG. 4 is a diagrammatic view showing components a head-of-bed angle (HOBA) lockout system including an angle sensor operable to determine an angular position of a head section, an actuator operable to move the head section between angular positions, a HOBA lockout selector, and a controller coupled to the angle sensor, the HOBA lockout selector, and the actuator, the controller also being coupled to other user inputs, an alarm, and an optional remote computer.

As shown diagrammatically in FIG. 4, a head-of-bed angle lockout system 170 includes a head-of-bed angle (HOBA) sensor 172 operable to determine an angular position of the head section 20, a HOBA lockout selector 174 and a controller 176. The controller 176 is coupled to the angle sensor 172 and the HOBA lockout selector 156 to receive signals therefrom. The controller 176 activates an actuator 178 to move head section 20 unless HOBA lockout system 170 is activated in which case head section 20 cannot be moved below a threshold angle, such as 30 degrees or 45 degrees, just to name a couple examples.

The head section 20 is diagrammatically shown in FIG. 20 to pivot relative to the upper frame 16 about a simple pivot axis. However, in some embodiments, the head section 20 pivots about a moving axis or a compound axis or the like. Accordingly, all types of connections for coupling one deck section of a bed to another are within the scope of this disclosure including simple pivots, compound pivots, reduced-shear pivots, and pivots having arcuate tracks or slots, just to name a few.

Still referring to FIG. 4, controller 176 is also coupled to user inputs 180, an alarm 182, and, optionally, a remote computer device 184, such as a computer of a nurse call system, electronic medical records (EMR) system, admission/discharge/transfer (ADT) system or the like. User inputs 180 include the user inputs described above in connection with FIG. 2, for example, as well as the user inputs on caregiver control pod 44 of FIG. 1. Alarm 182 is activated aurally, visually, and/or tactilely to indicate any alarm conditions sensed by controller 176. Thus, the controller 176 block in FIG. 4 is intended to represent, diagrammatically, all of the electrical components of bed 10 other than those that are illustrated separately in FIG. 4. In some embodiments, controller 176 comprises various circuit modules that interconnect in a network configuration, such as a controller area network (CAN). The details of this sort of bed network configuration are shown and described in U.S. Pat. Nos. 6,658,680; 6,691,346; 6,957,461; and 7,296,312; each of which is hereby incorporated by reference herein to the extent not inconsistent with the present disclosure which shall control as to any inconsistencies.

It is contemplated by this disclosure that the head-of-bed angle of the head section 20 may be measured or calculated with respect to any other portion of the bed 10, such as for example the upper frame 16, seat section 22, or base frame 14, or with respect to horizontal or vertical. Thus, it is contemplated that one or more types of angle sensors 172, such as a potentiometer, limit switch, ball switch, accelerometer, inclinometer, linear variable displacement transducer (LVDT), or hall effect sensor, just to name a few, may be provided on bed 10 to provide signals that are used to measure or calculate angles of bed components to arrive at the head-of-bed angle of head section 20. In some embodiments, the angle sensor 172 is included as a component of the actuator 178. The actuator 178 may comprise an electrical linear actuator, for example, in such embodiments.

Figure 5:
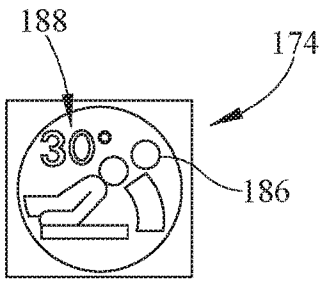
FIG. 5 is a front elevation view of one embodiment of a HOBA lockout selector.

Regardless of the type of sensor used, angle sensor 172 provides a sensor signal to controller 176 indicative of an angular position of the head section 20 of bed 10. When the HOBA lockout system 170 is disabled or deactivated (these terms are intended to be used interchangeably), actuator 178 is operable under the command of controller 176 to move the head section 20 between raised and lowered angular positions. FIG. 1 shows head section 20 in the lowered position, for example, and extreme uppermost dashed line in FIG. 4 is representative of the raised position of head section 20. In FIG. 5, head section 20 itself, is shown in an intermediate position between the raised and lowered positions.

HOBA lockout selector 174 has an on state and an off state. The controller 176 is prevented from signaling the actuator 178 to move the head section 20 below a threshold HOBA defined between the raised and lowered angular positions when the HOBA lockout selector is in the on state. The controller 176 is permitted to signal the actuator 178 to move the head section 20 throughout a full range of motion between the raised and lowered angular positions when the HOBA lockout selector is in the off state. Any attempt to lower head section 20 below the threshold angle when the HOBA lockout selector is in the on state is considered an alarm condition, in some embodiments, resulting in controller 176 activating alarm 182 and/or sending an alarm signal to remote computer device 184.

The HOBA lockout selector 174 includes a button or a membrane switch in some embodiments. Alternatively or additionally, the HOBA lockout selector 174 is shown on a touchscreen display of bed 10. In some embodiments, the HOBA lockout selector 174 is located on a surface of a barrier, such as footboard 40 or siderails 48, a, 48*b*, 48*c*, 48*d*, for example. Typically, the surface on which selector 174 is located faces away from the patient supported on bed 10.

Additionally or alternatively, in some embodiments, the controller 176 is configured to receive a signal from remote computer device 184 to change the HOBA lockout selector 174 between the on state and the off state. The threshold HOBA is a fixed value that may be stored in a memory associated with the controller 176 in some embodiments. Alternatively or additionally, the threshold HOBA is selectable between first and second threshold angles, or really, any number of desired threshold angles. For example, the threshold HOBA may be selectable using a graphical caregiver interface of the patient support apparatus 10.

Referring now to FIG. 5, one example lockout selector 174 comprises a button that is pressed sequentially to toggle between the on and off states. The button is included as part of a membrane switch, for example. In the illustrative example, HOBA lockout selector 174 includes a visual indicator 186 to indicate whether the HOBA lockout selector 174 is in the on state or the off state. The visual indicator 186 includes a light, such as a light emitting diode, for example. The light is illuminated when the HOBA lockout selector 174 is in the on state and the light is off when the HOBA lockout selector is in the off state. In the illustrative example of FIG. 5, an indicia 188 indicates that the threshold HOBA is 30 degrees. In embodiments of bed 10 having multiple threshold HOBA's, other buttons similar to the illustrative button 174 are provided with their respective indicia indicating the associated HOBA threshold. Thus, buttons having 45 degrees, 60 degrees, and so forth indicate on indicia 188 are contemplated by this disclosure. Such buttons may be located adjacent each other on a control panel and then the caregiver selects the desired lockout angle for the threshold HOBA. Then, depending upon which button is selected, controller 176 prevents head section 20 from being lowered below the selected threshold HOBA indicated.

Although certain illustrative embodiments have been described in detail above, variations and modifications exist within the scope and spirit of this disclosure as described and as defined in the following claims.

The invention claimed is:

1. A patient control unit for controlling functions of a hospital bed, the patient control unit comprising a housing having a first side and a second side that face in opposite directions, the first side including a plurality of user inputs accessible to a patient to control the functions of the hospital bed while the patient is supported on the hospital bed in a supine position, and the second side having a dock to secure a handheld phone in place on the housing, a first stay-in-bed indicia coupled to the first side of the housing and visible to the patient on the hospital bed in the supine position when the first side of the housing is viewed by the patient, and a second stay-in-bed indicia coupled to the second side of the housing and visible to the patient on the hospital bed in the supine position when the second side of the housing is viewed by the patient, wherein each of the first and second stay-in-bed indicia lights up to warn the patient to stay in the hospital bed.

2. The patient control unit of claim 1, wherein the dock comprises a clamp.

3. The patient control unit of claim 2, wherein the clamp comprises a pair of clamp members.

4. The patient control unit of claim 3, wherein at least one clamp member of the pair of clamp members is spring loaded and movable to permit the dock to accommodate handheld phones of different sizes.

5. The patient control unit of claim 1, wherein the plurality of user inputs on the first side of the housing includes a nurse call button and further comprising a second nurse call button on the second side of the housing, each of the first and second nurse call buttons being usable to send a nurse call signal from the hospital bed to a nurse call system.

6. The patient control unit of claim 5, wherein the second nurse call button is located generally beneath the handheld phone when the handheld phone is secured to the dock and the second side of the housing is oriented generally vertically.

7. The patient control unit of claim 1, further comprising an arm assembly having a first end coupled to the housing and having a second end coupled to the hospital bed.

8. The patient control unit of claim 7, wherein the second end of the arm assembly is couplable to a pivotable head section of the hospital bed.

9. The patient control unit of claim 7, wherein the arm assembly includes an arm that is configured to suspend the housing over a torso of a patient supported on the hospital bed.

10. The patient control unit of claim 9, wherein the housing is pivotable relative to the arm between a first position in which the first side of the housing is presented to the patient and a second position in which the second side of the housing is presented to the patient.

11. The patient control unit of claim 7, wherein the housing has a top edge extending between the first and second sides and wherein the first end of the arm assembly is coupled to the top edge of the housing.

12. The patient control unit of claim 1, wherein the housing is formed to include an aperture defining a grip handle at a bottom of the housing such that the user inputs are located above the grip handle on the first side of the housing and the dock is located above the grip handle on the second side of the housing.

13. The patient control unit of claim 1, wherein the housing is generally trapezoidal in shape when viewed facing the first side and when viewed facing the second side.

14. A patient support apparatus comprising a frame and the patient control unit of claim 1 coupled to the frame.

15. The patient support apparatus of claim 14, further comprising a head section coupled to the frame and movable relative to the frame between raised and lowered angular positions, the head section being configured to support at least a portion of a torso of a patient, a sensor operable to provide a sensor signal indicative of an angular position of the head section, an actuator that is operable to move the head section between the raised and lowered angular positions, a controller coupled to the sensor and to the actuator, the controller being configured to signal the actuator to move the head section (20), and a head-of-bed angle (HOBA) lockout selector coupled to the controller, the HOBA lockout selector having an on state and an off state, wherein the controller is prevented from signaling the actuator to move the head section below a threshold HOBA that is defined between the raised and lowered angular positions when the HOBA selector is in the on state and wherein the controller is permitted to signal the actuator to move the head section throughout a full range of motion between the raised and lowered angular positions when the HOBA selector is in the off state.

16. The patient control unit of claim 1, wherein the first stay-in-bed indicia is located generally above the plurality of user inputs when the first side of the housing is oriented generally vertically.

17. The patient control unit of claim 16, wherein the second stay-in-bed indicia is located generally above the handheld phone when the handheld phone is secured to the dock and the second side of the housing is oriented generally vertically.

18. The patient control unit of claim 1, wherein the second stay-in-bed indicia is located generally above the handheld phone when the handheld phone is secured to the dock and the second side of the housing is oriented generally vertically.

* * * * *